US008330345B2

(12) United States Patent
Kirshner et al.

(10) Patent No.: US 8,330,345 B2
(45) Date of Patent: Dec. 11, 2012

(54) ACTIVE ELECTRONICALLY STEERED CATHODE EMISSION

(75) Inventors: Mark Frederick Kirshner, Redwood City, CA (US); Craig Bisset Wilsen, Redwood City, CA (US); Richard Donald Kowalczyk, San Francisco, CA (US)

(73) Assignee: L-3 Communications Corporation, San Carlos, CA (US)

( * ) Notice: Subject to any disclaimer, the term of this patent is extended or adjusted under 35 U.S.C. 154(b) by 772 days.

(21) Appl. No.: 12/551,110

(22) Filed: Aug. 31, 2009

(65) Prior Publication Data

US 2011/0050096 A1 Mar. 3, 2011

(51) Int. Cl.
*H01J 29/46* (2006.01)

(52) U.S. Cl. ..... 313/447; 313/409; 313/446

(58) Field of Classification Search ..... 313/409, 313/446, 447

See application file for complete search history.

(56) References Cited

U.S. PATENT DOCUMENTS

| | | | | |
|---|---|---|---|---|
| 3,585,438 | A * | 6/1971 | Bell | 313/338 |
| 4,621,218 | A | 11/1986 | Jasper et al. | |
| 5,021,708 | A * | 6/1991 | Nugues et al. | 313/446 |
| 5,196,765 | A | 3/1993 | MacMaster et al. | |
| 5,315,207 | A * | 5/1994 | Hoeberechts et al. | 313/444 |
| 6,130,502 | A * | 10/2000 | Kobayashi et al. | 313/446 |
| 6,664,547 | B2 | 12/2003 | Benveniste | |
| 7,473,914 | B2 | 1/2009 | Todd et al. | |
| 7,688,132 | B2 | 3/2010 | Kirshner et al. | |

* cited by examiner

*Primary Examiner* — Thuy Vinh Tran

(74) *Attorney, Agent, or Firm* — O'Melvany & Myers LLP

(57) ABSTRACT

An active electronically steered cathode (AESC) applies one or more electromagnetic modes to an input cavity, similar to that used in an inductive output tube. The structure and superposition of these modes creates local electric field maxima, causing the electron emission site or sites to move or be distributed across the surface of the cathode. Changing the amplitude, phase, or frequency of the modes provides time-variable control of the electric field profile, thereby generating electronically steered electron beams. One embodiment employs a pair of orthogonal TM modes driven out of phase, causing the electric field maximum to rotate around an annular cathode, producing a helical beam. Slots in the control grid may be used to segment the helical beam into discrete bunches to provide additional density modulation.

34 Claims, 11 Drawing Sheets

$\cos(2\theta)\cos(\omega t)$ $\sin(2\theta)\cos(\omega t - 90°)$ $\cos(2\theta)\cos(\omega t) + \sin(2\theta)\cos(\omega t - 90°)$

ACTIVE ELECTRONICALLY STEERED CATHODE EMISSION

BACKGROUND OF THE INVENTION

1. Field of the Invention

The present invention relates to emission-gated electron-beam devices and more particularly to devices including an active electronically steered cathode for generating one or more electron beams that are electronically steered at their points of origin.

2. Description of Related Art

In a conventional density-modulated device, such as an inductive output tube (IOT), radio-frequency (RF) gating of electron emission is accomplished using an input cavity structure that develops a peak electric field between the cathode surface and a control grid. By biasing the control grid with respect to the cathode, the cathode can be made to emit electrons during part of the RF cycle. As a result, the electron beam is modulated at the RF drive frequency.

In some applications, it is desirable to generate a helical or deflection-modulated beam. Conventionally, such a beam is generated using bending fields that operate on the electron beam to deflect its trajectory. However, applying bending fields tends to degrade the quality of the electron beam, making it unsuitable in applications that require precise control of the beam trajectory, such as in high-frequency devices where circuit dimensions and geometries are small. In addition, because voltage ripple may cause positional deviations, exceedingly tight power-supply regulation that is difficult to achieve may be required in many applications. Accordingly, it would be desirable to provide an apparatus and method for generating an electronically steered electron beam that overcomes these and other drawbacks of the prior art.

SUMMARY OF THE INVENTION

An active electronically steered cathode (AESC) comprises a cathode having an emissive surface that is located within an enclosure. A control grid is placed in close proximity to the extended cathode, defining a G-K gap between the grid and the cathode. The enclosure is adapted to have a first input port and a second input port adapted to couple a first RF signal and a second RF signal, respectively, into the G-K gap. The first RF signal and the second RF signal interact to create an electromagnetic field within the G-K gap that has at least one field maximum located near a portion of the emissive surface of the cathode. A voltage bias is applied to the control grid and adjusted such that the cathode begins to emit electrons in the vicinity of the one or more electromagnetic field maxima. The field maxima and the grid bias thus operate to define one or more emission sites along the emissive surface of the cathode.

In an embodiment of an AESC in accordance with the present invention, the first and second RF signals are adjusted such that the maxima of the electromagnetic field move along the surface of the cathode as a function of time. The RF signals may further be adapted such that the maxima of the electromagnetic field move with a substantially constant velocity.

In another embodiment of an AESC in accordance with the present invention, the cathode is configured to be substantially annular in shape, and the first and second RF signals are adjusted such that the electromagnetic field maxima move along the cathode on a path that is substantially circular. When the motion along this circular path is adjusted such that its velocity is substantially constant, the electron beams emitted are substantially helical in shape.

In another embodiment of an AESC in accordance with the present invention, the control grid may be adapted to comprise a series of discrete slots or windows through which the electron beam may exit the cavity. When the emission sites are moved along the emissive surface of the cathode, the emitted electron beam will thus be transmitted out of the cavity only when an emission site aligns with a slot in the grid. The resulting electron beams thus become density modulated.

In some embodiments of an AESC in accordance with the present invention, the first RF signal is adapted to be orthogonal to the second RF signal. The phase of the second RF signal may further be adapted to be 90 degrees out of phase with respect to the first RF signal. Furthermore, it is possible to configure the first and second RF signals such that the electromagnetic field is either a transverse-magnetic (TM) field or a transverse-electric (TE) field.

In yet another embodiment of an AESC in accordance with the present invention, the first and second RF fields are configured such that m electromagnetic field maxima are produced to define m emission sites along the emissive surface of the cathode, wherein m is a positive integer. As described above, the RF signals can be adjusted to cause the m emission sites to move along the surface of the cathode, thereby causing electronic steering of the m emitted electron beams.

In some embodiments of an AESC in accordance with the present invention, the first input port and the second input port are located around an outside surface of the enclosure and separated by 360*(2N+1)/4m degrees, wherein N is a positive integer and m is the number of emission sites, as defined above.

In another embodiment of an AESC in accordance with the present invention, the enclosure is substantially rectangular in shape and is adapted to act as a rectangular waveguide wherein the first RF signal is introduced at one end of the enclosure and the second RF signal is introduced from the other end. The signals interfere within the rectangular cavity to produce a standing wave that includes one or more maxima distributed along the cathode, which is substantially rectangular in shape.

In another embodiment of an AESC in accordance with the present invention, one or both of the RF signals input into the cavity are comprised of a Fourier sum of harmonic frequency components. If the cavity is designed so that these harmonic frequency components excite spatial harmonics of the corresponding order, the Fourier sum creates an electromagnetic field waveform that may be more steeply peaked than a single harmonic. This results in a potentially smaller emission site on the surface of the cathode and thus greater control over the emission sites of the electron beams.

Thus, certain benefits of an active electronically steered cathode have been achieved. Further advantages and applications of the invention will become clear to those skilled in the art by examination of the following detailed description of the preferred embodiment. Reference will be made to the attached sheets of drawing that will first be described briefly.

DETAILED DESCRIPTION OF THE PREFERRED EMBODIMENT

Figure 1:
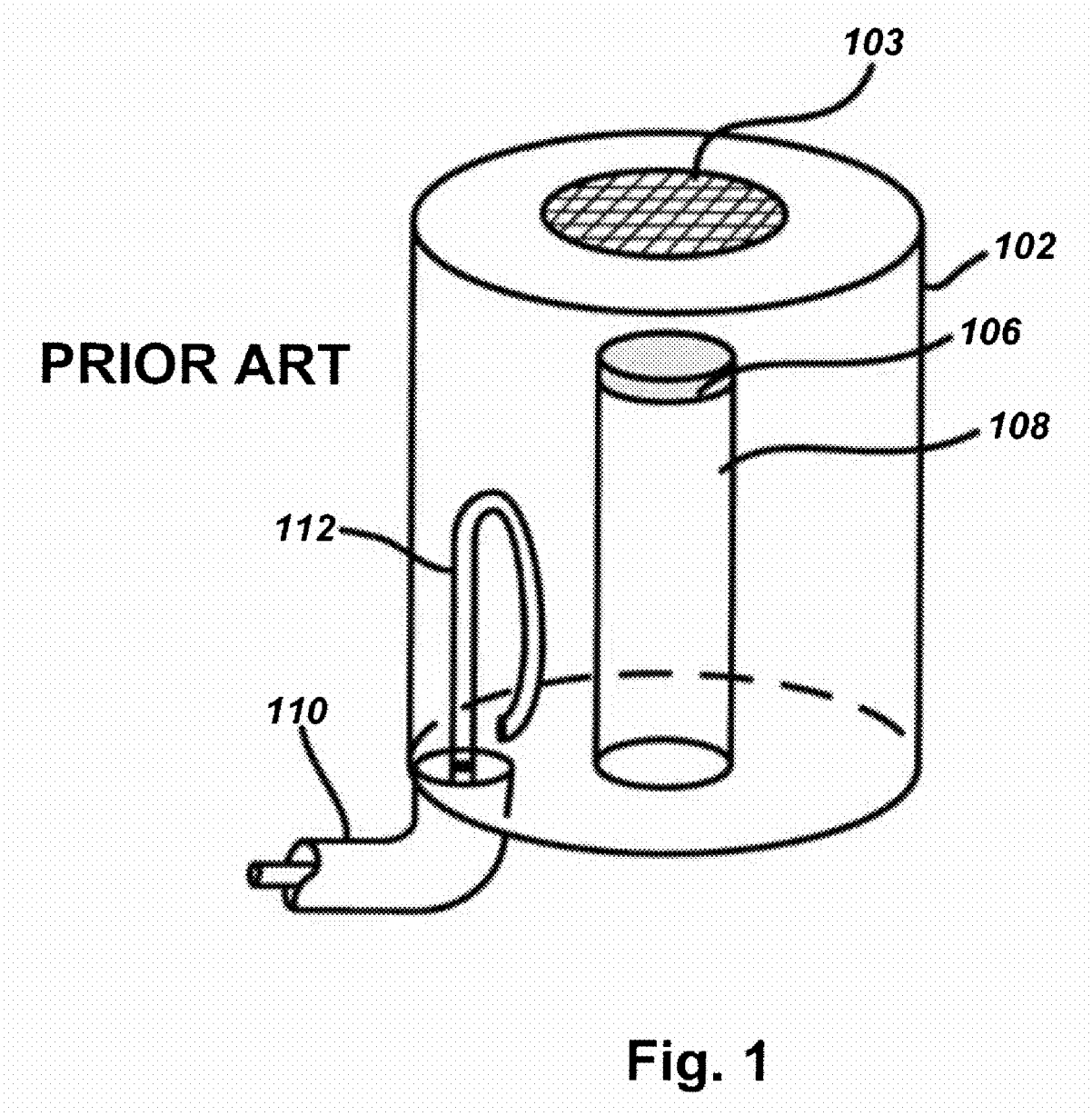
FIG. 1 depicts an exemplary inductive output tube (IOT), typical of the prior art.

In its simplest form, an active electronically steered cathode (AESC) is similar to the input cavity of a conventional inductive output tube (IOT). FIG. 1 depicts an input cavity of an IOT, typical of the prior art. A resonant cavity 102 includes a cathode 106 atop a cathode support structure 108. A control grid 103 is positioned above the cathode 106, and a radio-frequency (RF) signal is coupled into the cavity via an RF transmission line 110 coupled to an inductive loop 112. An anode (not shown in FIG. 1) is located outside of the resonant input cavity and is biased with respect to the cathode to draw an electron beam from the cathode. The control grid 103 is positioned close to the cathode to define a G-K gap between the cathode and the control grid, and the grid is typically held at a DC potential of several hundred volts with respect to the cathode 106. This steady bias, in combination with the RF signal coupled into the G-K gap, can be used to pulse the emission of the electron beam on and off and also to control the amount of idle current, which is the steady-state component of the electron beam current. When the RF drive signal is applied, electron emission is facilitated by the RF electric field in the G-K gap. The RF modulated electron beam is subsequently accelerated by the anode field, and power is extracted at an output cavity (not shown).

Figure 2A:
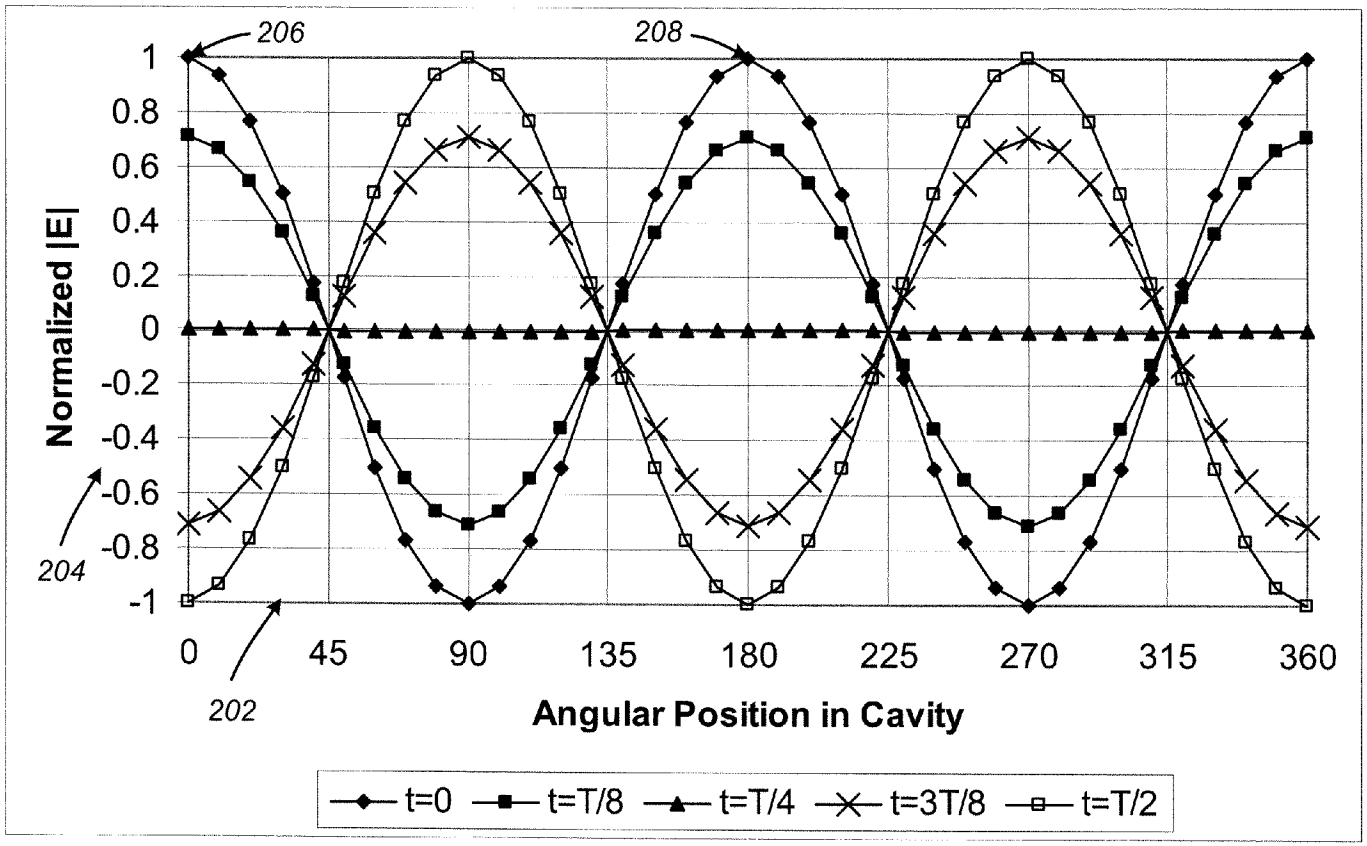
FIGS. 2*a*-2*d* depict RF signal profiles adapted to electronically steer electron beams in an AESC in accordance with the present invention.
Figure 2B:
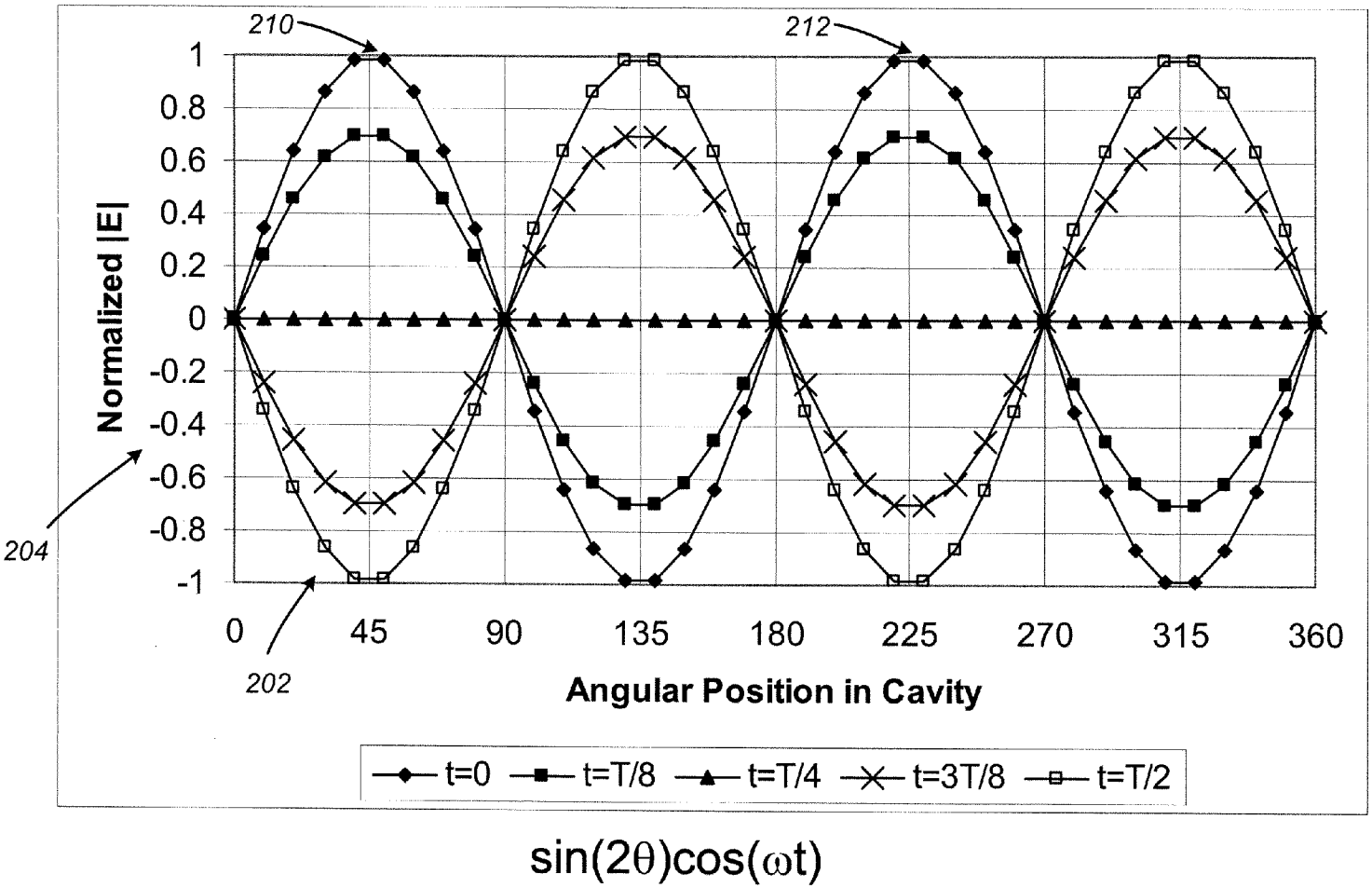
Figure 2C:
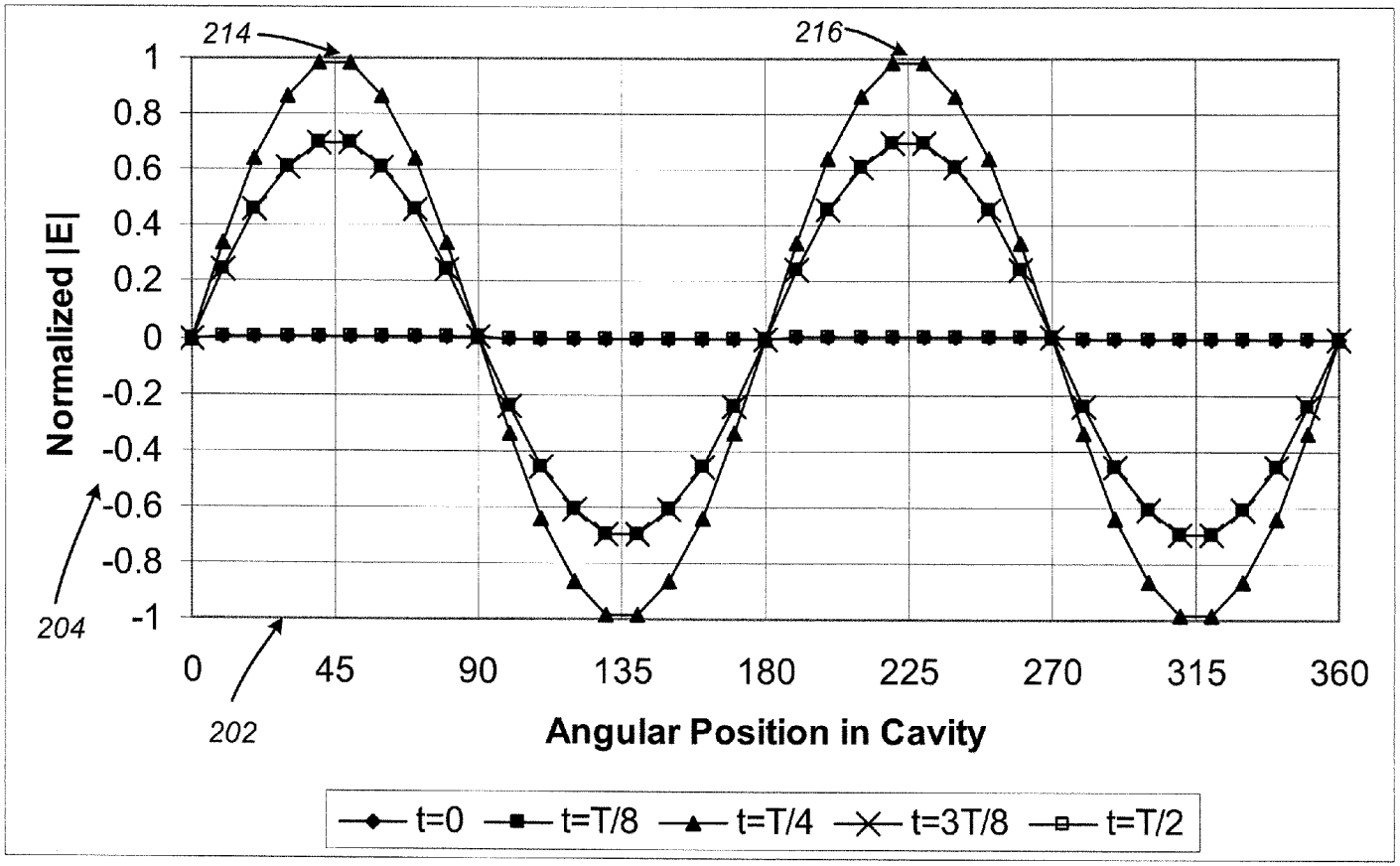

In an embodiment of an AESC in accordance with the present invention, the electron beam emitted from the cathode 106 is electronically steered directly at its point of origin by creating a rotating electromagnetic mode within the input cavity that moves the electron emission site around the surface of the cathode 106. For example, a rotating electromagnetic mode may be created in the G-K gap by driving it in quadrature. To do so, a first mode, described by the expression $\cos(\theta)\cos(\omega t)$, is combined with a second, orthogonal mode that is $\pi/2$ radians out of phase and described by the expression $\sin(\theta)\cos(\omega t-\pi/2)$. The combined field is then expressed as $\cos(\theta)\cos(\omega t)+\sin(\theta)\cos(\omega t-\pi/2)$. This is equivalent to $\cos(\theta)\cos(\omega t)+\sin(\theta)\sin(\omega t)$, which can also be expressed as $\cos(\theta-\omega t)$. For a fixed signal amplitude, $\theta-\omega t$ is equal to a constant, k, so $\theta=k+\omega t$. For modes having m azimuthal variations, $\theta$ is replaced by $m\theta$. Changing the order of the operating mode provides electronic control of the number and rotational frequency of the electron emission sites on the surface of the cathode. FIGS. 2*a*-2*d* illustrate the combination of fields 90 degrees out of phase. In FIGS. 2*a*-2*d*, angular position within the input cavity is plotted along the horizontal axis 202, and the normalized electric field magnitude is plotted along the vertical axis 204. The magnitude of the electric field is plotted at five instants in time (t), corresponding to t=0, t=T/8, t=T/4, t=3T/8, and t=T/2, where T is the period of the RF field coupled into the G-K gap. In FIG. 2*a*, a second-order mode is illustrated, having peaks at 0 and 180 degrees at t=0, as indicated at 206 and 208. In FIG. 2*b*, an orthogonal field is depicted, having t=0 peaks at 45 and 225 degrees, as indicated at 210 and 212. In FIG. 2*c*, the orthogonal mode of FIG. 2*b* is further shifted in phase by 90 degrees, such that the peaks at 45 and 225 degrees now occur at t=T/4, or one quarter of the way through the RF cycle, as illustrated at 214 and 216. Finally, in FIG. 2*d*, the fields depicted in FIG. 2*a* and in FIG. 2*c* are combined to produce two rotating maxima in the electric field that scan around the surface of the cathode. As can be seen from FIG. 2*d*, the maxima at time t=0, illustrated at 218 and 220, propagate as a linear function of time, reaching the positions indicated at 222 and 224, respectively, at t=T/2. In other words, the velocity of the field maxima's motion along the cathode is substantially constant. Thus, by combining two orthogonal modes ninety degrees out of phase, it is possible to produce a rotating mode that selectively initiates electron emission from a location on the surface of the cathode that moves as a function of time. Thus, the AESC provides electronic steering at the point of generation of the electron beam.

Figure 2D:
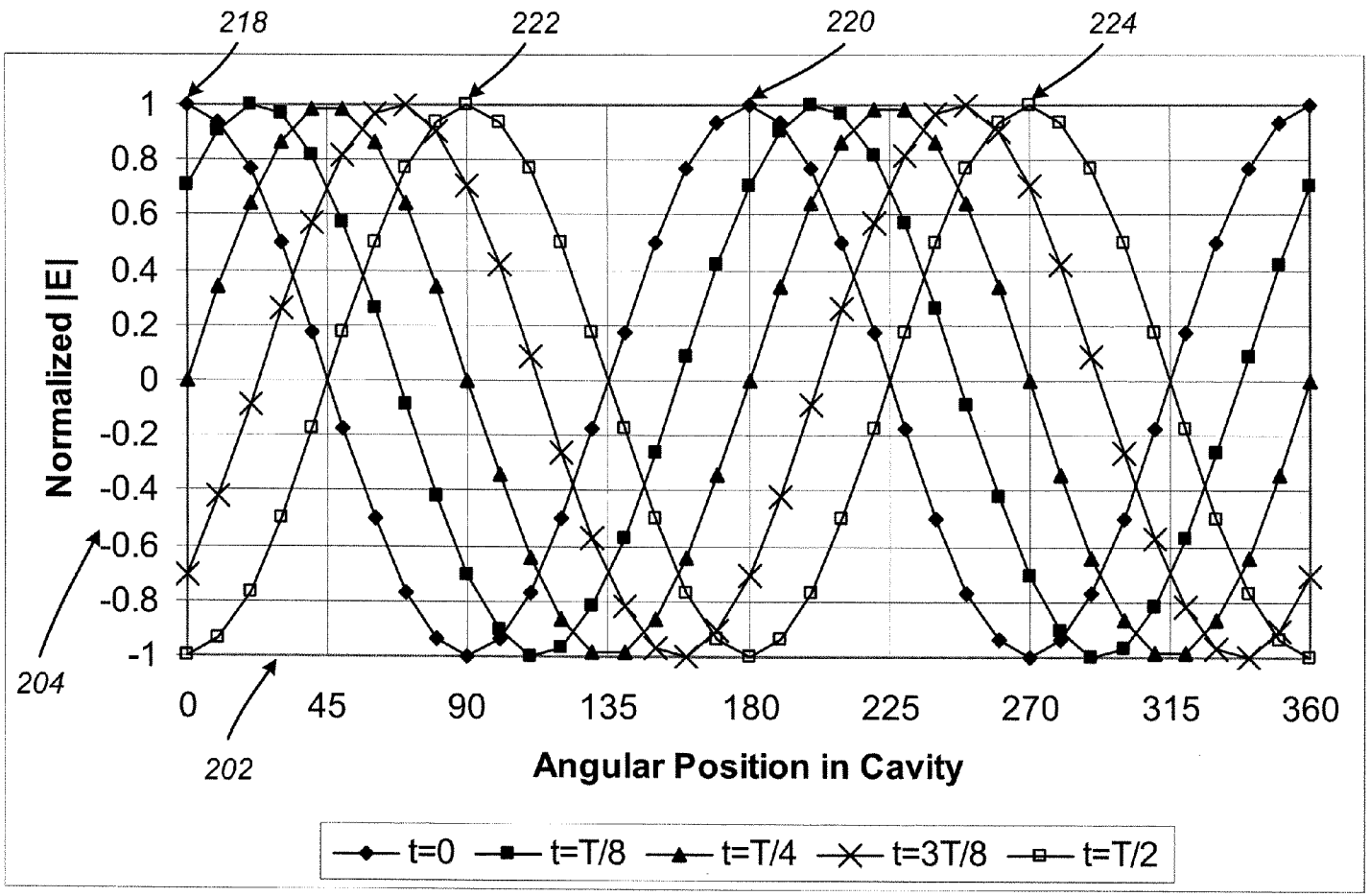

In order to couple to the orthogonal modes, it is preferred to provide plural drive ports around the input cavity, separated by 360*(2N+1)/4m degrees, where N is an integer (N=0, 1, 2, . . . ), and m is the order of the azimuthal variation of the $TM_{mnp}$ mode. $TM_{mnp}$ refers to the standard transverse-magnetic modes supported within a cylindrical cavity, where m, n, and p take on the values m=0, 1, 2, . . . ; n=1, 2, 3 . . . ; and p=0, 1, 2 . . . . When driven 90 degrees out of phase, as illustrated in FIG. 2*d*, the orthogonal standing waves of order m and frequency $f_o$ cause the electron emission sites to move across the cathode surface at a rotational frequency of $f_o/m$. It should be appreciated that transverse electric (TE) modes could be used as well as transverse magnetic (TM) modes, and such systems would also fall within the scope and spirit of the present invention.

Figure 3:
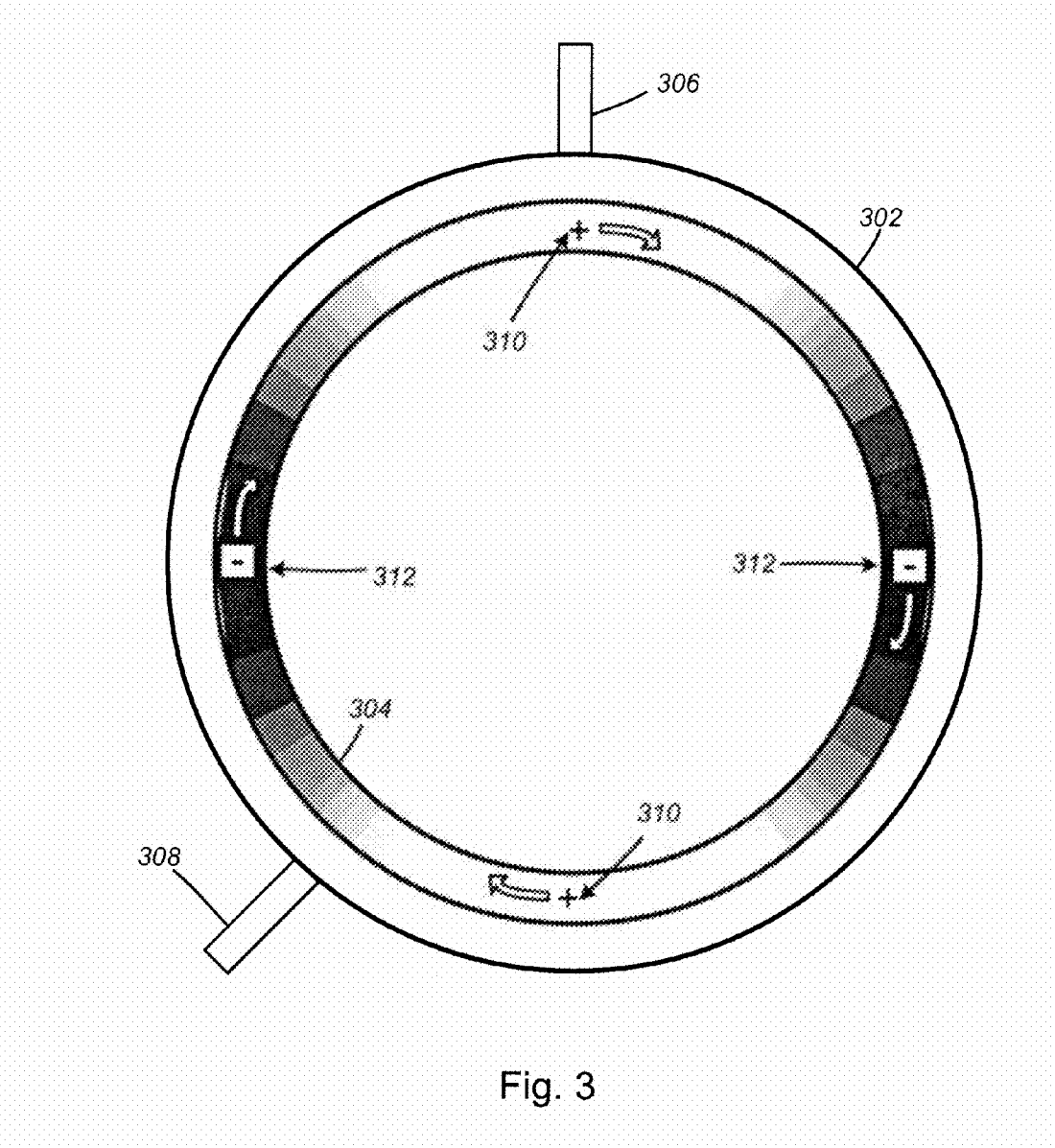
FIG. 3 is a schematic drawing of an AESC in accordance with the present invention depicting two field maxima distributed along a surface of an annular cathode.

In a preferred embodiment of an AESC in accordance with the present invention, the cathode is configured to have a substantially annular structure, and it is housed within a pillbox cavity that is adapted to support a rotating electromagnetic field within the G-K gap. FIG. 3 illustrates an embodiment of such a cathode showing simulated $TM_{211}$ field distributions across the surface of the cathode. The annular cathode 304 is located inside a pillbox cavity 302 having two RF drive ports 306 and 308 for coupling an RF signal into the cavity. The two electric field maxima 310 and electric field minima 312 propagate around the surface of the cathode 304 at a frequency of $f_o/m$, as discussed above. Electrons are emitted from the cathode in the regions of high electric field, enabling beam steering without having to use the bending fields typical of the prior art.

Figure 4:
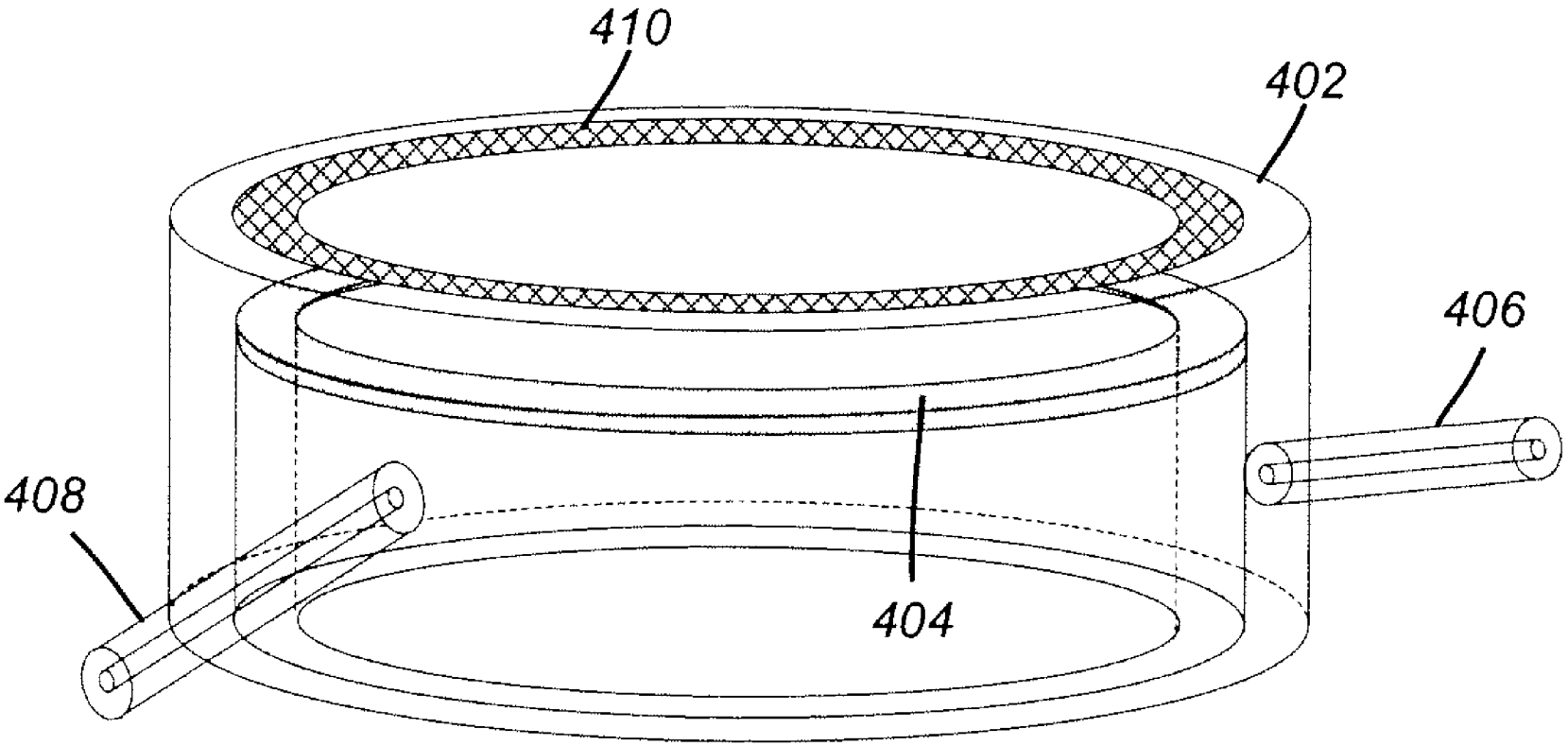
FIG. 4 is a three-dimensional view of an exemplary cavity including an annular cathode and having two input ports in accordance with an embodiment of the present invention.

FIG. 4 is a perspective drawing of an embodiment of an AESC in accordance with the present invention. A pillbox cavity 402 surrounds an annular cathode 404. Two drive ports 406 and 408 are connected to the cavity 402 and are separated by 360*(2N+1)/4m degrees, or 135 degrees for N=1 and m=2. This excites the $TM_{211}$ mode, also illustrated in FIGS. 2*d* and 3. The annular shape of the cathode 404 creates a well-defined locus of electron beam emission sites for precise steering of the electron beam. It may be advantageous to further shape the emitting surface to improve the beam quality and to equalize the transit time of electrons emitted from different locations of the cathode. A control grid 410 is located in close proximity to the cathode 404 and defines the G-K gap within which the rotating electromagnetic field stimulates emission of electrons from the cathode. It should be appreciated that the bias voltage of the grid can be tuned to be very close to the cut-off voltage so that the cathode will emit electrons only near the peak of the RF cycle. This will have the effect of limiting the spatial extent of the electron emission regions for further control of the electron beam steering and will also limit the emitted beam current.

Figure 5:
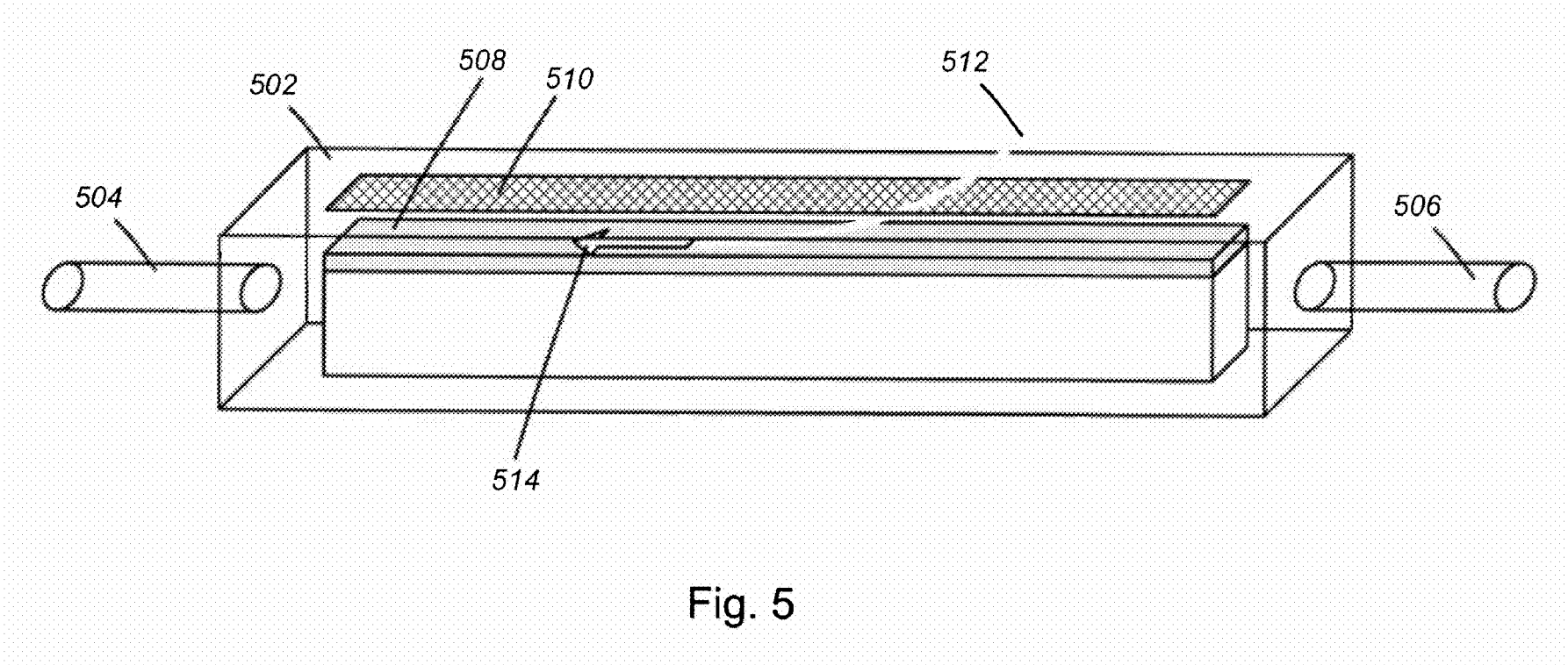
FIG. 5 depicts an alternative embodiment of an AESC in accordance with the present invention having a rectangular cavity that functions as a waveguide.

The AESC can also be configured to exploit travelling wave modes. For example, in a waveguide with drive ports on either end, the modal pattern generated by the interference of the two travelling waves can be controlled by changing the phase, amplitude, or frequency of one or both of the drive signals. FIG. 5 depicts an embodiment of an AESC in accordance with the present invention comprising a waveguide 502 having two drive ports 504 and 506, one on each end of the waveguide 502. RF signals are coupled into the waveguide 502 from each of the drive ports 504 and 506. An elongated cathode 508 is located within the waveguide in close proximity to a control grid 510. By appropriately adjusting the amplitude and phase of the coupled RF signals, an electromagnetic interference pattern can be established in the gap between the cathode 508 and grid 510 to control emission of an electron beam 512. For example, the input signals can be phased to produce one or more field maxima that scan along the cathode as indicated at 514 to produce an electron beam 512 that is spatially scanned at its point of origin. Because the cavity structure in this case may no longer be resonant, considerably more power may be required to produce comparable emitted beam current.

Figure 6:
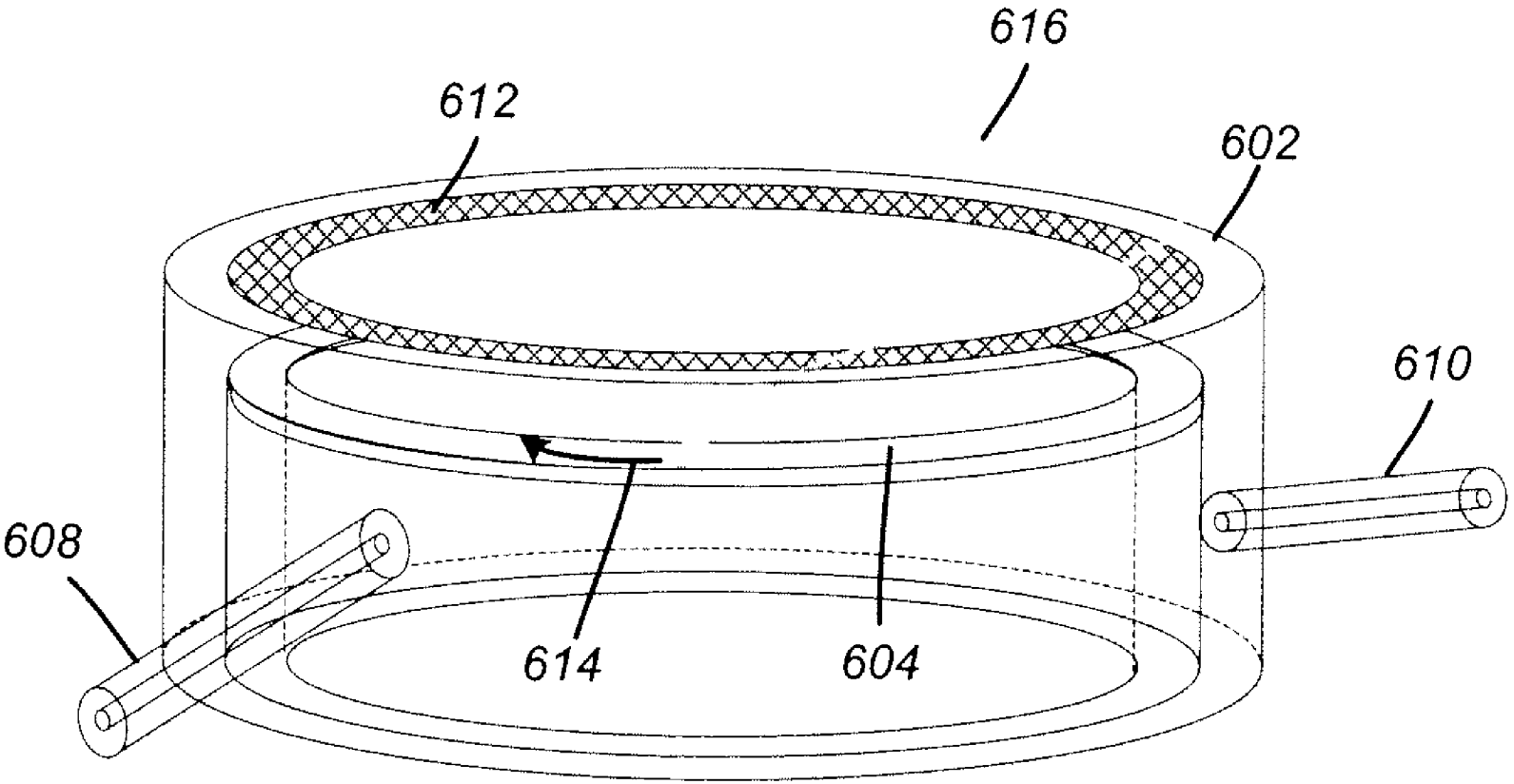
FIG. 6 depicts an embodiment of an AESC in accordance with the present invention in which an annular cathode is made to emit a helical electron beam.

FIG. 6 depicts an embodiment of an annular AESC in accordance with the present invention and configured to produce a helical electron beam. A pillbox cavity 602 includes a substantially annular cathode 604 in close proximity to a control grid 612. RF signals are coupled into the cavity through input ports 608 and 610. The phases of the coupled signals are adjusted to produce a rotating field, and the grid voltage is adjusted to permit electron emission at the peak of the electric field established in the cavity. This produces an electron emission site that scans around the surface of the cathode, as indicated at 614, producing an electron beam 616 that is helical in shape. Of course, by using higher order modes, as described earlier, multiple scanning emission sites can be established along the surface of the cathode to produce multiple helical beams, if desired. Thus, a helical or deflection modulated beam is produced without relying on a deflection cavity to bend a linear electron beam. This is advantageous because using a bending cavity can degrade the quality of an electron beam, making it unsuitable for applications requiring precise control of the beam trajectory, such as high-frequency devices in which circuit dimensions are small. Furthermore, in certain configurations, exceedingly tight regulation of the cathode voltage is required to prevent positional deviations caused by voltage ripple. This embodiment of an AESC addresses this problem by steering the electron beam at its source, thereby decoupling beam position from cathode voltage fluctuation. Furthermore, the AESC is much more compact than a standard beam deflection system.

Positional control of the electron beam using an AESC in accordance with the present invention is beneficial in the design of transverse beam amplifiers and various deflection modulated electron tubes. Other applications that may potentially benefit from the invention include scanned x-ray sources, lithographic systems, and phased array radar transmitters. A cold test model of an AESC has been fabricated and successfully tested at 2 GHz. The desired orthogonal modes were excited, producing four emission sites that were scanned across the model cathode surface.

Figure 7:
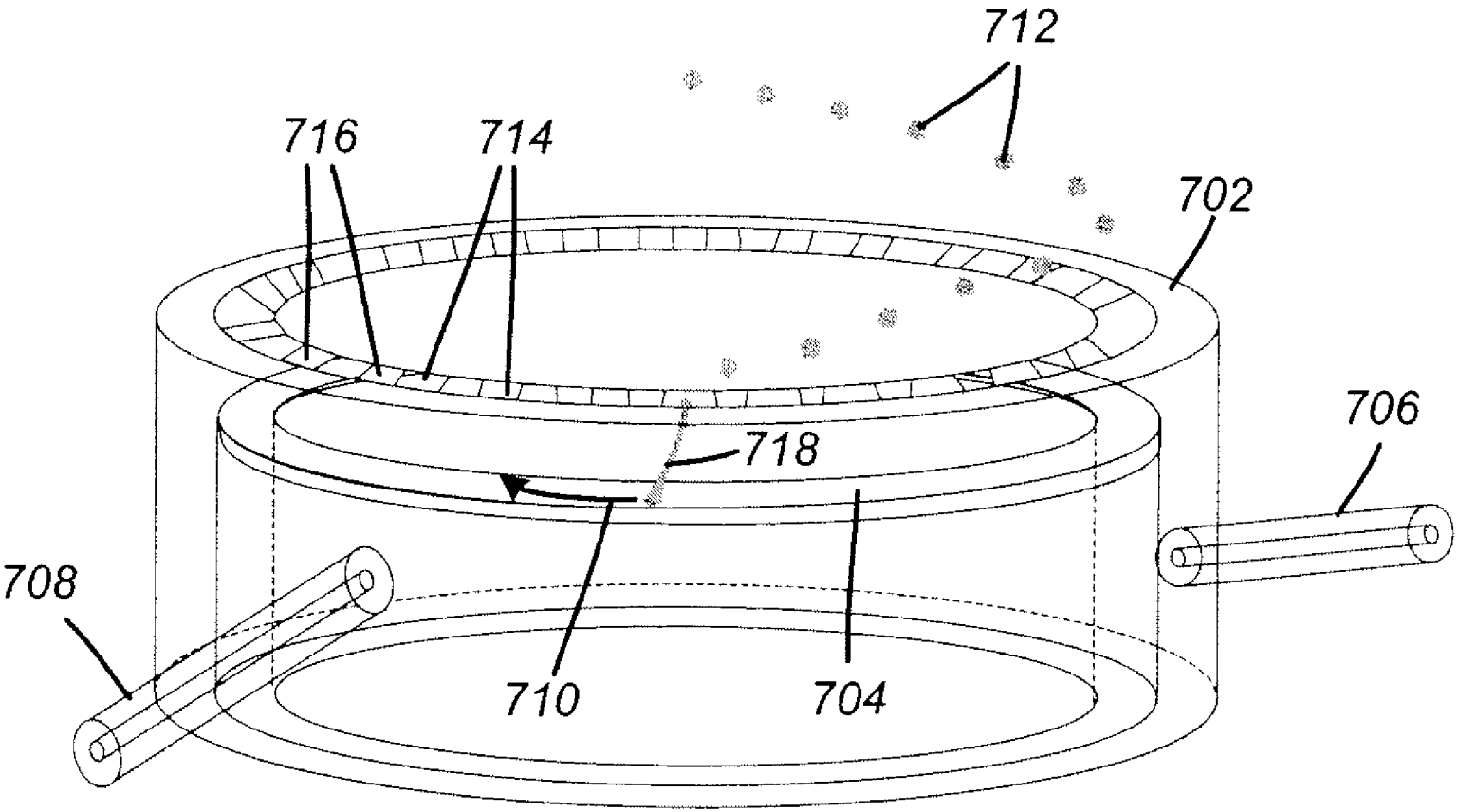
FIG. 7 depicts an alternative embodiment of an AESC in accordance with the present invention in which the control grid comprises a plurality of slots, creating a density-modulated electron beam.

FIG. 7 depicts an alternative embodiment of an annular AESC in accordance with the present invention that is configured to produce a helical, density-modulated electron beam. A pillbox cavity 702 includes an annular cathode 704 and two input ports 706 and 708, configured to develop a rotating electromagnetic field within the pillbox cavity 702. The control grid comprises alternating solid plates, e.g., 716, and slots, e.g., 714, that create windows that permit the electron beam 718 to exit the cavity. The electromagnetic field within the cavity causes the electron-beam emission site to scan around the surface of the cathode 704 as indicated at 710. As the electron beam 718 encounters the control grid plates 716, it is absorbed. But when it encounters a slot 714, it is able to exit the cavity, producing a series of electron bunches 712 that propagate through the apparatus.

Figure 8:
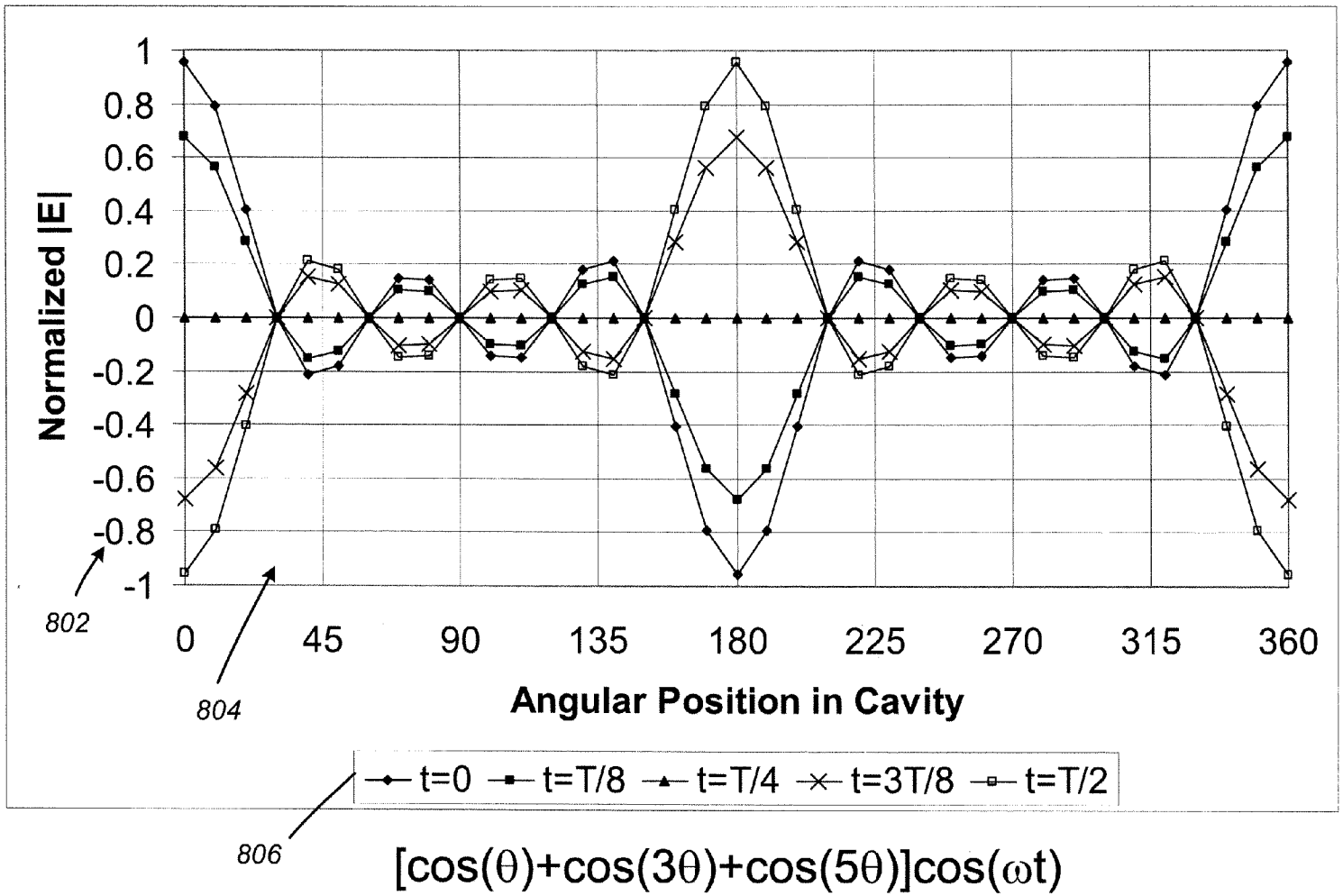
FIG. 8 is a plot of an exemplary RF signal used to drive an AESC in accordance with the present invention wherein the signal is comprised of a sum of Fourier components.

In various embodiments of an AESC in accordance with the present invention, the electric field within the cavity is generated by one or more standing waves, one or more travelling waves, or a combination thereof. Furthermore, the RF electric field can be arbitrarily shaped by adding a spectrum of Fourier components. For example, injection of an appropriately phased third harmonic signal will sharpen the edges of the field maxima, making the cathode emission region more localized. FIG. 8 depicts one example of a Fourier sum of components to control the spatial extent of the electron emission sites. The angular position within a pillbox cavity is plotted along the horizontal axis 804, and the normalized electric field magnitude is plotted along the vertical axis 802. As in FIGS. 2*a*-2*d*, plots of the electric field are illustrated for five instants in time, as indicated in the legend 806. In this example, the first, third and fifth harmonics are combined to produce a sharp peak in the electric field at 0 degrees. By appropriate combination of this field with an orthogonal field 90 degrees out of phase, this pattern can be made to scan along the cathode, as described earlier with reference to FIG. 2*d*. If the cavity is designed so that these harmonic frequency components excite spatial harmonics of the corresponding order, the combination of Fourier components results in a sharper peak and thus a narrower electron emission site at the surface of the cathode.

Although the embodiments described herein depict an AESC used in inductive output tube applications, it should be appreciated that the AESC is equally applicable to other electron beam devices. These and other applications of the invention should be readily apparent to one skilled in the art, and such applications and adaptations would fall within the scope and spirit of the present invention. The invention is further defined by the following claims.

What is claimed is:

1. An active electronically steered cathode (AESC) comprising:

a cathode having an emissive surface;

a control grid situated in close proximity to the cathode and defining a G-K gap between the cathode and the control grid, wherein the control grid is biased to maintain a voltage potential with respect to the cathode;

an enclosure substantially enclosing the cathode and the G-K gap and having a first input port adapted to couple a first radio-frequency (RF) signal into the G-K gap, and a second input port adapted to couple a second RF signal into the G-K gap, wherein:

the first RF signal and the second RF signal combine to produce an electromagnetic field in the G-K gap having at least one electromagnetic field maximum near a portion of the emissive surface of the cathode such that the at least one electromagnetic field maximum and the voltage potential of the control grid define at least one emission site on the cathode and cause the cathode to emit an electron beam from the at least one emission site.

2. The AESC of claim 1, wherein the first RF signal and the second RF signal are further adapted such that the at least one electromagnetic field maximum moves as a function of time across the emissive surface of the cathode, causing the at least one emission site to move across the emissive surface of the cathode, so that the electron beam is steered as a function of time.

3. The AESC of claim 2, wherein the first RF signal and the second RF signal are further adapted such that the at least one electromagnetic field maximum moves at a velocity that is substantially constant.

4. The AESC of claim 2, wherein the cathode is configured to be substantially annular in shape and wherein the first RF signal and the second RF signal are further adapted such that the at least one electromagnetic field maximum moves along a substantially circular path across the annular cathode.

5. The AESC of claim 4, wherein the first RF signal and the second RF signal are further adapted such that the at least one electromagnetic field maximum moves along the substantially circular path at a velocity that is substantially constant such that the electron beam is substantially helical in shape.

6. The AESC of claim 5, wherein the control grid comprises a plurality of discrete slots such that the electron beam may exit the enclosure through one of the plurality of discrete slots when the at least one emission site is aligned with the one of the plurality of discrete slots, such that the electron beam exiting the enclosure is density modulated.

7. The AESC of claim 1, wherein the first RF signal and the second RF signal are configured to be orthogonal to each other.

8. The AESC of claim 7, wherein the first RF signal and the second RF signal are further adapted such that the second RF signal is shifted ninety degrees in phase with respect to the first RF signal.

9. The AESC of claim 1, wherein the electromagnetic field in the G-K gap is configured to be a transverse-electric (TE) field.

10. The AESC of claim 1, wherein the electromagnetic field in the G-K gap is configured to be a transverse-magnetic (TM) field.

11. The AESC of claim 1, wherein the first RF signal and the second RF signal are further adapted to produce m electromagnetic field maxima distributed along the emissive surface of the cathode, wherein m is positive integer, such that m electron beams are emitted from m emission sites along the emissive surface of the cathode.

12. The AESC of claim 11, wherein the first RF signal and the second RF signal are further adapted such that the m electromagnetic field maxima move as a function of time across the emissive surface of the cathode, causing the m emission sites to move across the emissive surface of the cathode, so that the m electron beams are steered as a function of time.

13. The AESC of claim 12, wherein the cathode is configured to be substantially annular in shape and wherein the first RF signal and the second RF signal are further adapted such that the m electromagnetic field maxima move along a substantially circular path across the annular cathode such that the m electron beams are each substantially helical in shape.

14. The AESC of claim 13, wherein the enclosure is substantially cylindrical in shape and wherein the first input port and the second input port are arranged around a circumference of the enclosure and separated by 360*(2N+1)/4m degrees, wherein N is a positive integer.

15. The AESC of claim 13, wherein the control grid comprises a plurality of discrete slots such that the m electron beams may exit the enclosure through the plurality of discrete slots when corresponding ones of the m emission sites are aligned with ones of the plurality of discrete slots, such that the m electron beams exiting the enclosure are density modulated.

16. The AESC of claim 1, wherein the enclosure is substantially rectangular in shape and configured to act as a waveguide for the first RF signal and the second RF signal coupled into the G-K gap, and wherein the cathode is substantially rectangular in shape.

17. The AESC of claim 16, wherein the first RF signal and the second RF signal are further adapted such that a standing wave is generated within the enclosure.

18. The AESC of claim 1, wherein at least one of the first RF signal and the second RF signal comprises a Fourier sum of p RF signals that are harmonically related, wherein p is a positive integer greater than one.

19. An active electronically steered cathode (AESC) comprising:

a cathode having an emissive surface that is substantially annular in shape;

a control grid situated in close proximity to the cathode and defining a G-K gap between the cathode and the control grid, wherein the control grid is biased to maintain a voltage potential with respect to the cathode;

an enclosure substantially enclosing the cathode and the G-K gap and having at least a first input port adapted to couple a first radio-frequency (RF) signal into the G-K gap, and a second input port adapted to couple a second RF signal into the G-K gap, wherein:

the first RF signal and the second RF signal are adapted to generate an electromagnetic field in the G-K gap having m electromagnetic field maxima distributed along the emissive surface of the cathode such that the m electromagnetic field maxima and the voltage potential of the control grid define m emission sites on the cathode and cause the cathode to emit m electron beams from corresponding ones of the m emission sites.

20. The AESC of claim 19, wherein the first RF signal and the second RF signal are configured to be orthogonal to one another.

21. The AESC of claim 20, wherein the first RF signal and the second RF signal are further adapted such that the second RF signal is shifted ninety degrees in phase with respect to the first RF signal.

22. The AESC of claim 19, wherein the electromagnetic field in the G-K gap is configured to be a transverse-electric (TE) field.

23. The AESC of claim 19, wherein the electromagnetic field in the G-K gap is configured to be a transverse-magnetic (TM) field.

24. The AESC of claim 19, wherein the first RF signal and the second RF signal are further adapted such that the m electromagnetic field maxima move along a substantially circular path across the annular cathode.

25. The AESC of claim 24, wherein the first RF signal and the second RF signal are further adapted such that the m electromagnetic field maxima move along the substantially circular path at a velocity that is substantially constant such that the m electron beams are each substantially helical in shape.

26. The AESC of claim 25, wherein the substantially constant velocity is equal to $f_o/m$, wherein $f_o$ is a frequency of the first RF signal.

27. The AESC of claim 19, wherein the control grid comprises a plurality of discrete slots such that the m electron beams may exit the enclosure when the m emission sites are aligned with corresponding ones of the plurality of discrete slots, such that the m electron beams exiting the enclosure are density modulated.

28. A method of electronically steering an electron beam at its point of origin comprises the steps of:

locating a cathode having an emissive surface within an enclosure having at least a first input port and a second input port;

locating a control grid in close proximity to the cathode to define a G-K gap between the cathode and the control grid;

biasing the control grid to achieve a voltage potential difference between the control grid and the cathode;

coupling a first radio-frequency (RF) signal into the enclosure through the first input port and a second RF signal into the enclosure through the second input port such that the first and second RF signals combine to generate an electromagnetic field within the G-K gap having m maxima distributed along the emissive surface of the cathode, wherein m is a positive integer;

adjusting the voltage potential of the control grid to define m emission sites along the emissive surface of the cathode corresponding to the m maxima of the electric field;

extracting m electron beams from corresponding ones of the m emission sites along the cathode.

29. The method of claim 28, further comprising the steps of:

adapting the second RF signal to be orthogonal to the first RF signal; and adjusting a phase of the second RF signal to be 90 degrees out of phase with the first RF signal.

30. The method of claim 28, further comprising the step of adapting the first RF signal and the second RF signal such that the m maxima of the electromagnetic field move along the emissive surface of the cathode as a function of time.

31. The method of claim 30, further comprising adapting the first RF signal and the second RF signal such that the m maxima of the electromagnetic field move along the emissive surface of the cathode at a velocity that is substantially constant.

32. The method of claim 28, further comprising adapting the control grid to include a plurality of discrete slots such that the m electron beams may exit the enclosure when the m emission sites are aligned with corresponding ones of the plurality of discrete slots, such that the m electron beams exiting the enclosure are density modulated.

33. The method of claim 28, further comprising locating the first input port and the second port along the enclosure such that they are separated by 360*(2N+1)/4m degrees, wherein N is a positive integer.

34. The method of claim 28, further comprising the step of adapting at least one of the first RF signal and the second RF signal to be a sum of Fourier components such that the m emission sites have a smaller spatial extent along the emissive surface of the cathode.

* * * * *